US010919549B2

(12) United States Patent
Bartek

(10) Patent No.: US 10,919,549 B2
(45) Date of Patent: Feb. 16, 2021

(54) LANTERN AND MULTI-FUNCTIONAL LED LIGHT FOR RAILWAYS

(71) Applicant: Protran Technology, LLC, West Columbia, SC (US)

(72) Inventor: Peter M. Bartek, Ledgewood, NJ (US)

(73) Assignee: PROTRAN TECHNOLOGY, LLC, West Columbia, SC (US)

( * ) Notice: Subject to any disclaimer, the term of this patent is extended or adjusted under 35 U.S.C. 154(b) by 0 days.

(21) Appl. No.: 16/560,242

(22) Filed: Sep. 4, 2019

(65) Prior Publication Data

US 2020/0070855 A1 Mar. 5, 2020

Related U.S. Application Data

(60) Provisional application No. 62/727,387, filed on Sep. 5, 2018.

(51) Int. Cl.
*B61L 5/18* (2006.01)
*B61L 23/06* (2006.01)
(Continued)

(52) U.S. Cl.
CPC ..... *B61L 5/189* (2013.01); *B61L 5/1827* (2013.01); *B61L 23/06* (2013.01); *F21L 4/027* (2013.01);
(Continued)

(58) Field of Classification Search
CPC .. F21L 4/027; F21Y 2107/90; F21Y 2105/10; F21V 23/0442; F21V 23/0464; F21V 23/0471
See application file for complete search history.

(56) References Cited

U.S. PATENT DOCUMENTS 5,036,442 A * 7/1991 Brown ..... A63B 15/00 362/102
6,547,410 B1 4/2003 Pederson
(Continued)

FOREIGN PATENT DOCUMENTS

CN 2444841 Y 8/2001
CN 101149134 A 3/2008
(Continued)

OTHER PUBLICATIONS lumastrobe.com, "Railway Barricade Light," visited Aug. 7, 2018 @ https://www.lumastrobe.com/shop/products/railway-safety-blue-lights-lx-51b-b/.
(Continued)

*Primary Examiner* — Alexander K Garlen
(74) *Attorney, Agent, or Firm* — Norton Rose Fulbright US LLP

(57) ABSTRACT

Aspects of the disclosure relate to a lantern/multi-functional hand-held LED light for railways. The lantern/multi-functional LED light may provide a rail worker with one light device to be used for many railway applications. The lantern/multi-functional LED light may have a two-sided light capability and the ability to provide warning and lighting on both a front panel and a back panel of the lantern/multi-functional LED. The lantern/multi-functional hand-held LED light may include one or more of the following features: two-sided with extra-bright warning LEDs orientated in rows that allow the lantern/multi-functional LED light to light-up a work area, multi-color with different flash rates, sensor to allow for orientation position indication and automatic ON/OFF on one side, bottom base magnetic mount, two bright top-mounted LED lights and two side-top LEDs that allow the lantern/multi-functional LED light to be used as a flash light.

20 Claims, 4 Drawing Sheets

(51) Int. Cl.

| | |
|---|---|
| ***F21L 4/02*** | (2006.01) |
| ***F21V 23/04*** | (2006.01) |
| ***F21V 21/096*** | (2006.01) |
| ***F21V 21/088*** | (2006.01) |
| ***F21W 111/10*** | (2006.01) |
| ***F21Y 115/10*** | (2016.01) |
| ***F21Y 113/13*** | (2016.01) |
| ***F21Y 105/10*** | (2016.01) |

(52) U.S. Cl.
CPC ..... *F21V 21/0885* (2013.01); *F21V 21/0965* (2013.01); *F21V 23/0414* (2013.01); *F21V 23/0492* (2013.01); *F21W 2111/10* (2013.01); *F21Y 2105/10* (2016.08); *F21Y 2113/13* (2016.08); *F21Y 2115/10* (2016.08)

(56) References Cited

U.S. PATENT DOCUMENTS

| | | | | |
|---|---|---|---|---|
| 6,995,681 | B2 | 2/2006 | Pederson | |
| 7,046,160 | B2 | 5/2006 | Pederson et al. | |
| 8,297,775 | B2 | 10/2012 | Wright et al. | |
| 8,870,408 | B2 * | 10/2014 | Sharrah | F21V 23/026 362/217.13 |
| 9,970,600 | B1 | 5/2018 | Donnan | |
| 2006/0001547 | A1 | 1/2006 | Davenport et al. | |
| 2007/0064411 | A1 * | 3/2007 | Chang | A45B 3/04 362/102 |
| 2008/0007427 | A1 * | 1/2008 | Stokes | A41D 19/0157 340/901 |
| 2008/0218996 | A1 * | 9/2008 | Galloway | G08B 5/006 362/103 |
| 2009/0147519 | A1 | 6/2009 | Klipstein et al. | |
| 2009/0261737 | A1 * | 10/2009 | Wright | F21L 4/027 315/154 |
| 2012/0008310 | A1 * | 1/2012 | Staeubli | F21L 4/027 362/119 |
| 2012/0140467 | A1 * | 6/2012 | Chang | F21L 2/00 362/235 |
| 2016/0356438 | A1 | 12/2016 | Matson | |
| 2016/0356439 | A1 * | 12/2016 | Inskeep | F21L 4/08 |
| 2017/0023233 | A1 | 1/2017 | Matte et al. | |
| 2018/0376561 | A1 * | 12/2018 | Pham | F21V 23/0471 |

FOREIGN PATENT DOCUMENTS

| | | | |
|---|---|---|---|
| CN | 102448234 | A | 5/2012 |
| CN | 203223858 | U | 10/2013 |
| CN | 204759967 | U | 11/2015 |
| CN | 103939820 | B | 1/2017 |
| DE | 102010031163 | | 1/2012 |

OTHER PUBLICATIONS railteksupply.com, "Blue and Red LED D-Cell 360 Degree Flashing Light—Magnetic Base," visited Aug. 7, 2018 @ http://www.railteksupply.com/blue-red-lights html.

railteksupply.com—"LED D-Cell Portable Barricade Warning Light—Magnetic Base," visited Aug. 7, 2018 @ http://www.railteksupply.com/blue-red-lights-002.html.

International Search Report and Written Opinion issued in corresponding International Patent Application No. PCT/US2019/049510 dated May 11, 2020.

amazon.fr—"Xprite White and Emergency Amber Hazard Warning LED Mini Strobe Light Bar with Magnetic Base," visited Aug. 7, 2018 @ https://www.amazon.fr/Xprite-durgence-avertissement-stroboscopique-magn%C3%A9tique/dp/B0083CJAOO.

aliexpress.com "E USB Rechargeable LED Flashlight Collapsible COB Portable Work Light Magnetic Base Hook Inspection Lamp for Repairing Camping," visited Aug. 7, 2018 @ https://www.aliexpress.com/item/32895540081. html?spm=2114.search0104.3.63.24df1592KiCSuL&ws_ab_test=searchweb0_0,searchweb201602_3_10152_10065_10151_10344_10068_10342_10325_10343_10546_10340_10059_10341_10548_10696_100031_10084_10083_10103_10618_10307_10624_10623_10622_10621_10620,searchweb201603_2,ppcSwitch_3&algo_expid=ef8c0208-9a3e-4815-ac57-5ebe54a57edl-9&algo_pvid=ef8c0208-9a3e-4815-ac57-5ebe54a57ed1&priceBeautifyAB=0.

larsonelectronics.com, "18 Watt LED Flood Light with Magnetic Base," visited Aug. 7, 2018 @ https://www.larsonelectronics.com/blog/2016/05/11/new-product-release/18-watt-led-flood-light-magnetic-base/.

aliexpress.com, "2018 Flashlight 18650 360 Degree Rotating Hanging Hook and Magnetic Base Camping Light LED Flashlight Super Bright JA4," visited Aug. 7, 2018 @ https://www.aliexpress.com/item/32848462597.html?spm=2114.search0104.3.189.24df1592KiCSuL&ws_ab_test=searchweb0_0, searchweb201602_3_10152_10065_10151_10344_10068_10342_10325_10343_10546_10340_10059_10341_10548_10696_100031_10084_10083_10103_10618_10307_10624_10623_10622_10621_10621_10620,searchweb201603_2,ppcSwitch_3&algo_expid=ef8c0208-9a3e-4815-ac57-5ebe54a57ed1-28&algo_pvid=ef8c0208-9a3e-4815-ac57-5ebe54a57ed1&priceBeautifyAB=0.

navisafe.com, "Navilight Tricolor 2NM," visited Aug. 7, 2018 @ http://www.navisafe.com/project/3-navilight-tricolor-2nm-2/.

ebay.com, "Portable Magnetic Base 27W LED Work Light Floodlight Truck Car Lamp Light 12V," visited Aug. 7, 2018 @ https://www.ebay.com/itm/Portable-Magnetic-Base-27W-LED-Work-Light-Floodlight-Truck-Car-Lamp-Light-12V-/112651499701.

amazon.com, "Portable Wireless Motion Activated Detector Sensing LED Light Bar Automatic Stick-on Anyplace with Magnetic Strip (1Pack)," visited Aug. 7, 2018 @ https://www.amazon.com/Activated-LED-Light-Bar-Automatic/dp/B01I6CNNAM.

amazon.com, "Motion Sensor Night Light, Detachable Magnet Base, USB Rechargeable LED, Human Body Induction 360 Degree Rotation Night Light, Closet Lights Lamp, Stair Lights, Bathroom, Bedroom, Kitchen (WhiteLight)," visited Aug. 7, 2018 @ https://www.amazon.com/Detachable-Rechargeable-Induction-Rotation-WhiteLight/dp/B076P659TM.

* cited by examiner

LANTERN AND MULTI-FUNCTIONAL LED LIGHT FOR RAILWAYS

CROSS-REFERENCE TO RELATED APPLICATIONS

This application claims priority to U.S. Provisional Patent Application No. 62/727,387, filed Sep. 5, 2018, entitled Multi-Functional LED Light for Railways, which is incorporated herein by reference in its entirety and made a part hereof.

FIELD OF THE INVENTION

The present invention relates to railways and, more particularly, to a lantern/multi-functional LED light for railways that can be used in several key railway applications eliminating the use of several lights.

BACKGROUND

Currently, there is no lantern/multi-functional LED light for railways. Currently, the railway uses several different types of lights for different applications. Railways use different lights for most different applications.

SUMMARY

Aspects of the disclosure relate to a lantern/multi-functional hand-held LED light for railways. The lantern/multi-functional LED light may provide a rail worker with one light device to be used for many railway applications. The lantern/multi-functional LED light may have a two-sided light capability and the ability to provide warning and lighting on both a front panel and a back panel of the lantern/multi-functional LED. The lantern/multi-functional hand-held LED light may include one or more of the following features: two-sided with extra-bright warning LEDs orientated in rows that allow the lantern/multi-functional LED light to light-up a work area, multi-color with different flash rates, sensor to allow for orientation position indication and automatic ON/OFF on one side, bottom base magnetic mount, two bright top-mounted LED lights and two side-top LEDs that allow the lantern/multi-functional LED light to be used as a flash light.

According to an embodiment, a hand-held railway lantern for use on a railway may include a case, a work light, a flash light, and a sensor. The case may include a front panel, a back panel opposite the front panel, a top panel, a bottom panel, and two side panels connected to form a rectangular shape. The work light may include a plurality of LED lights located on the front panel and the back panel, the plurality of LED lights including a plurality of extra-bright LED lights with multi-colors. The work light may be configured to have two-sided light capability with the ability to provide warning and lighting on both the front panel and the back panel. The flash light may be located on the top panel and may include two bright top-mounted LED lights. The sensor may include orientation position indication and automatic ON/OFF on either the front panel or the back panel for the work light, wherein the sensor turns off one of the front panel or the back panel of the work light when one of the front panel or the back panel is covered.

Further, the case may hold a set of batteries and other electronics of the hand-held railway lantern. The work light may include 16 extra-bright LED lights orientated in a plurality of rows. Additionally, the plurality of LEDs on the work light may have various flash rates and colors. The hand-held railway lantern may further include a clip on the case to hang the hand-held railway lantern that allows the work light to light-up a work area when a rail worker needs to work hands-free. The flash light may also include two side-top LED lights. The hand-held railway lantern may further include a magnetic base located on the bottom panel to secure the hand-held railway lantern on a running rail for shunting applications or warning applications. The work light may also include a front array of lights on the front panel and a back array of lights on the back panel. Lastly, the hand-held railway lantern may further include a selector button located on the case to turn on and turn off the work light and the flash light.

According to another embodiment, a hand-held railway lantern for use on a railway may include a case, a work light, a flash light, a sensor, and a selector button. The case may include a front panel, a back panel opposite the front panel, a top panel, a bottom panel, and two side panels connected to form a rectangular shape. The work light may include a plurality of LED lights located on the front panel and the back panel, the plurality of LED lights including a plurality of extra-bright LED lights with multi-colors. The work light may be configured to have two-sided light capability with the ability to provide warning and lighting on both the front panel and the back panel. The flash light may be located on the top panel. The flash light may include two bright top-mounted LED lights and two side-top LED lights. The sensor may include orientation position indication and automatic ON/OFF on either the front panel or the back panel for the work light, wherein the sensor turns off one of the front panel or the back panel of the work light when one of the front panel or the back panel is covered. The selector button may be located on the case to turn on and turn off the work light and the flash light.

In yet another embodiment, a hand-held railway lantern for use on a railway may include a case, a work light, a flash light, a sensor, a clip, and a magnetic base. The case may include a front panel, a back panel opposite the front panel, a top panel, a bottom panel, and two side panels connected to form a rectangular shape. The work light may include a front array of lights on the front panel and a back array of lights on the back panel, the front array of lights and the back array of lights including a plurality of extra-bright LED lights with multi-colors, the front array of lights and the back array of lights may be configured to have two-sided light capability with the ability to provide warning and lighting on both the front panel and the back panel. The flash light may be located on the top panel. The flash light may include two bright top-mounted LED lights and two side-top LED lights. The sensor may include orientation position indication and automatic ON/OFF on either the front panel or the back panel for the work light, wherein the sensor turns off one of the front panel or the back panel of the work light when one of the front panel or the back panel is covered. The clip on the case to hang the hand-held railway lantern may allow the work light to light-up a work area when a rail worker needs to work hands-free. The magnetic base may be located on the bottom panel of the case to secure the hand-held railway lantern on a running rail for shunting applications or warning applications.

These features, along with many others, are discussed in greater detail below.

Figure 1A:
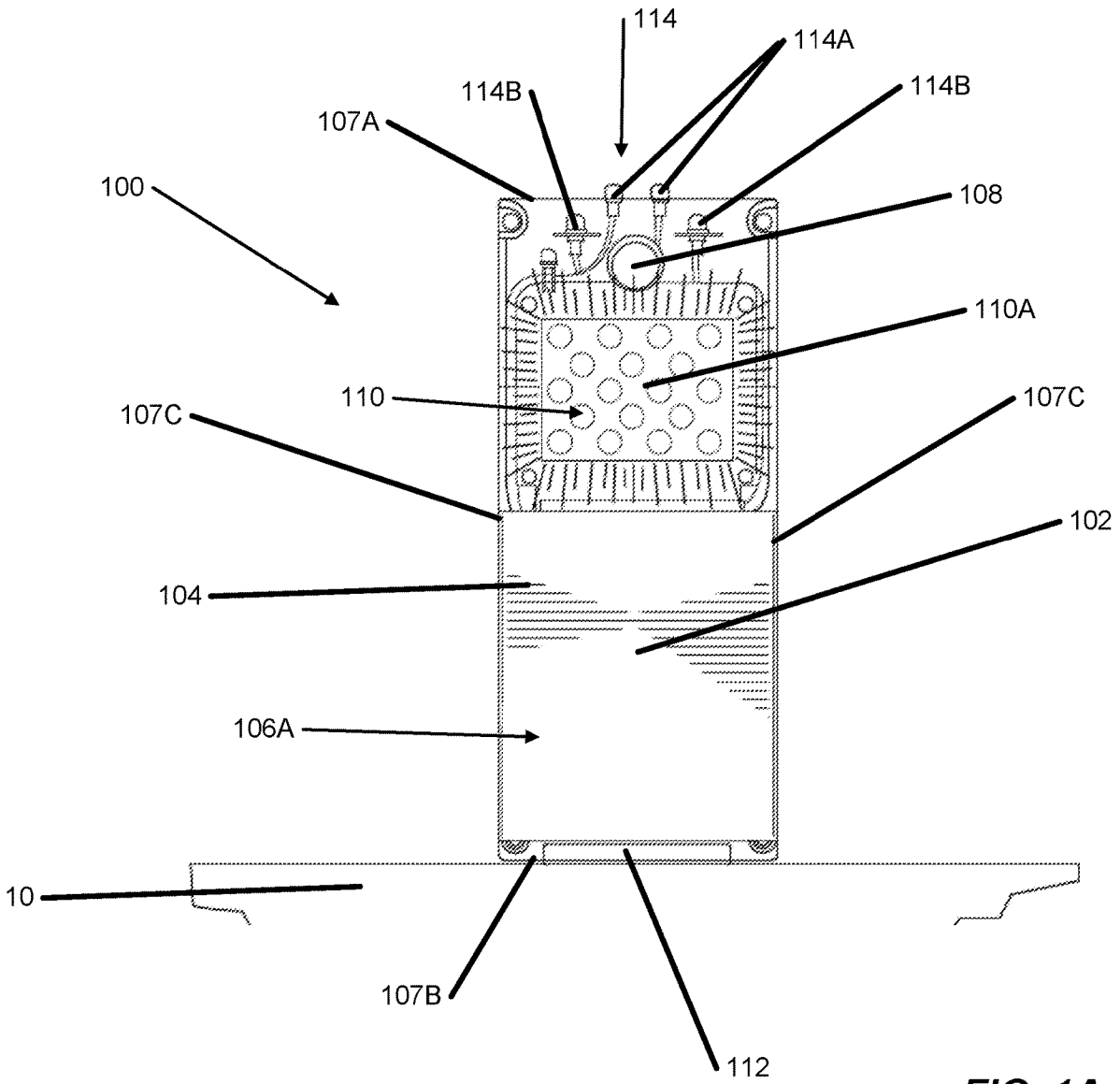
FIG. 1A is a front view of a lantern/lantern/multi-functional LED light for use in a railyard in accordance with an embodiment of the system of the present invention.

The reader is advised that the attached drawings are not necessarily drawn to scale.

DETAILED DESCRIPTION OF EMBODIMENTS

In the following description of various examples of the invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

FIGS. 1A through 3 illustrate a lantern/multi-functional LED light 100 for railways. The lantern/multi-functional LED light 100 may provide a rail worker with one light device to be used for many railway applications. The lantern/multi-functional LED light 100 for railways may meet federal railway regulations, such as 49 CFR 234.5. The lantern/multi-functional LED light 100 includes a case 102 that holds the batteries and other electronics of the railway lantern 100. The case 102 may be in a generally rectangular shape with a front panel 106A and a back panel 106B. The case 102 may also include a top panel 107A, a bottom panel 107B, and two side panels 107C. The case 102 may be other shapes without departing from this invention, such as square.

The lantern/multi-functional LED light 100 may have a two-sided light capability and the ability to provide warning and lighting on both the front panel 106A and the back panel 106B of the case 102. The lantern/multi-functional LED light 100 may include a work light 110. The work light 110 may cause the lantern/multi-functional LED light 100 to light-up a work area when a rail worker needs to work hands-free. The worker may clip the lantern/multi-functional LED light 100 to a structure and turn on the work light 110 to work hands-free.

Figure 1B:
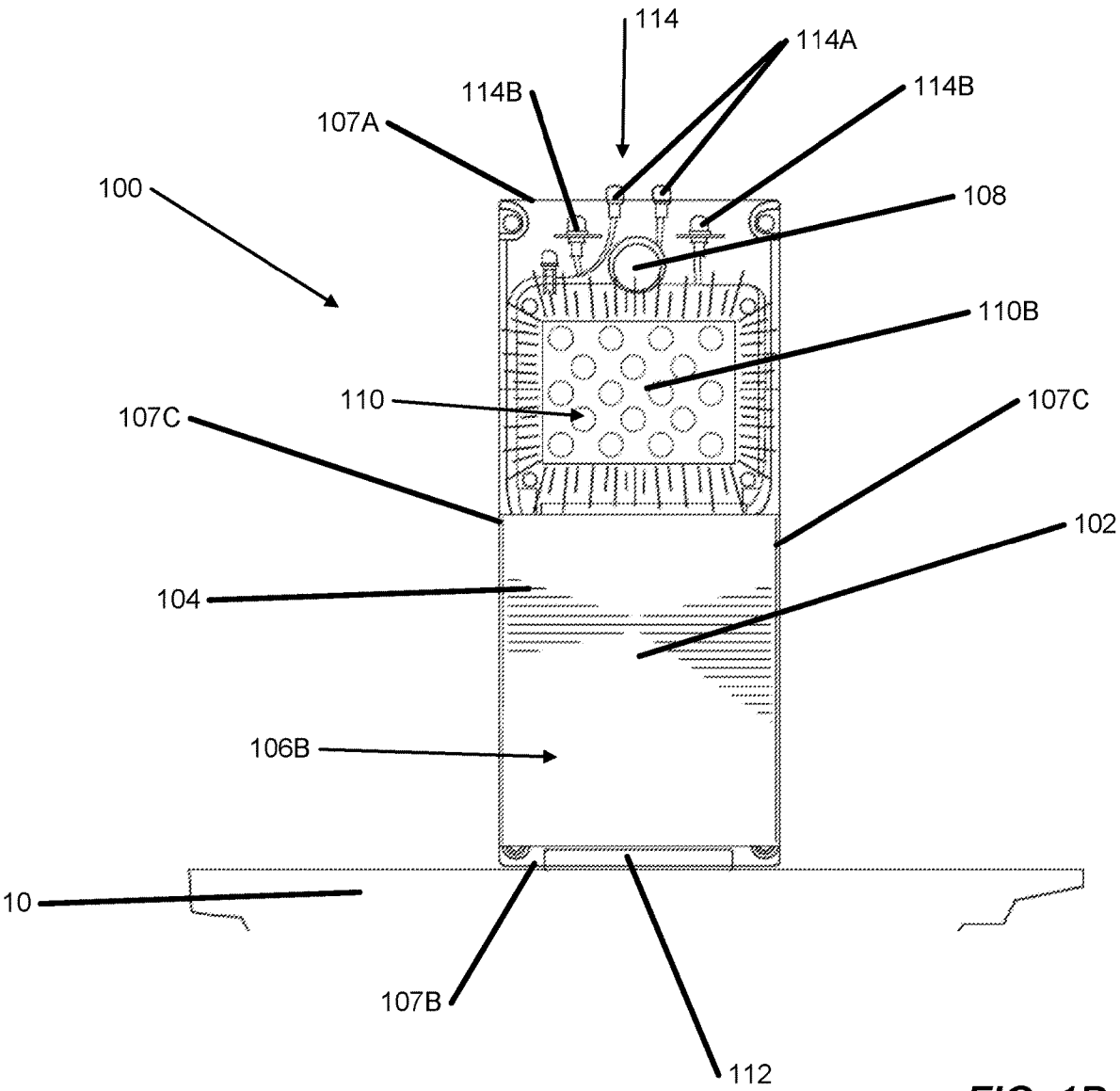
FIG. 1B is a back view of the lantern/lantern/multi-functional LED light from FIG. 1A in accordance with an embodiment of the system of the present invention.

As illustrated in FIGS. 1A and 1B, the work light 110 may include a front array of lights 110A on the front side 106A with extra-bright lights with multi-colors. The work light 110 may also include a back array of lights 110B on the back side 106B with extra-bright lights with multi-colors. These LEDs on the front array of lights 110A and the back array of lights 110B may be each in a configuration with up to 16 rows of LEDs of extra-bright warning LEDs. Other configurations of the front array of lights 110A and the back array of lights 110B may be utilized without departing from this invention. The LEDs may have various flash rates and colors as required.

In another embodiment of the invention, as illustrated in FIGS. 1A and 1B, the lantern/multi-functional LED light 100 may have a magnetic base 112 located on or near the bottom panel 107B of the case 102. The magnetic base 112 may secure the lantern/multi-functional LED light 100 on the top of a running rail 10 for shunting applications or warning applications on a magnetic surface. The magnetic base 112 may secure the lantern/multi-functional LED light 100 to any other metal surfaces as required.

Figure 2:
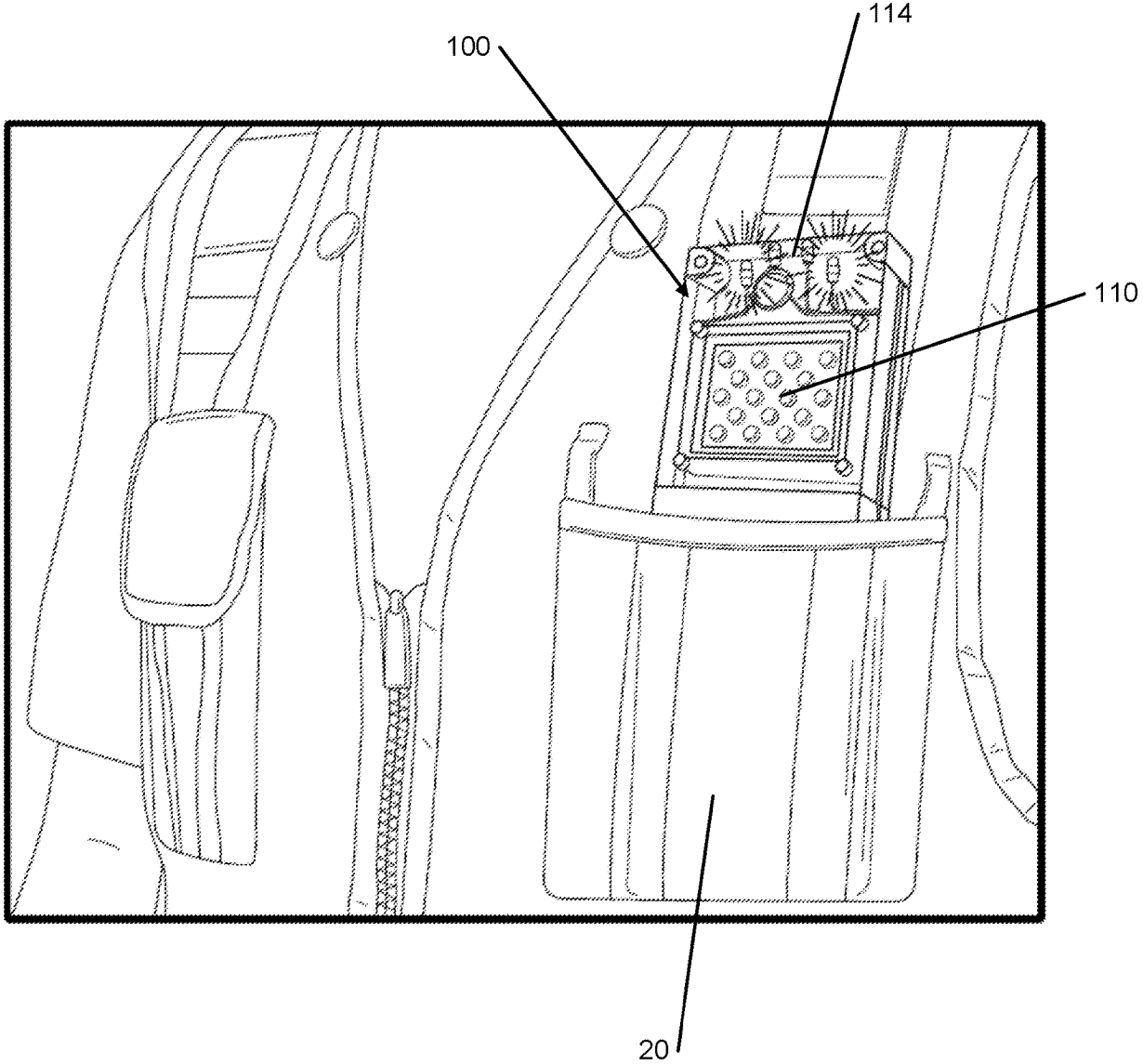
FIG. 2 is a front perspective view of the lantern/lantern/multi-functional LED light from FIG. 1A in a railyard worker's vest in accordance with an embodiment of the system of the present invention.
Figure 3:
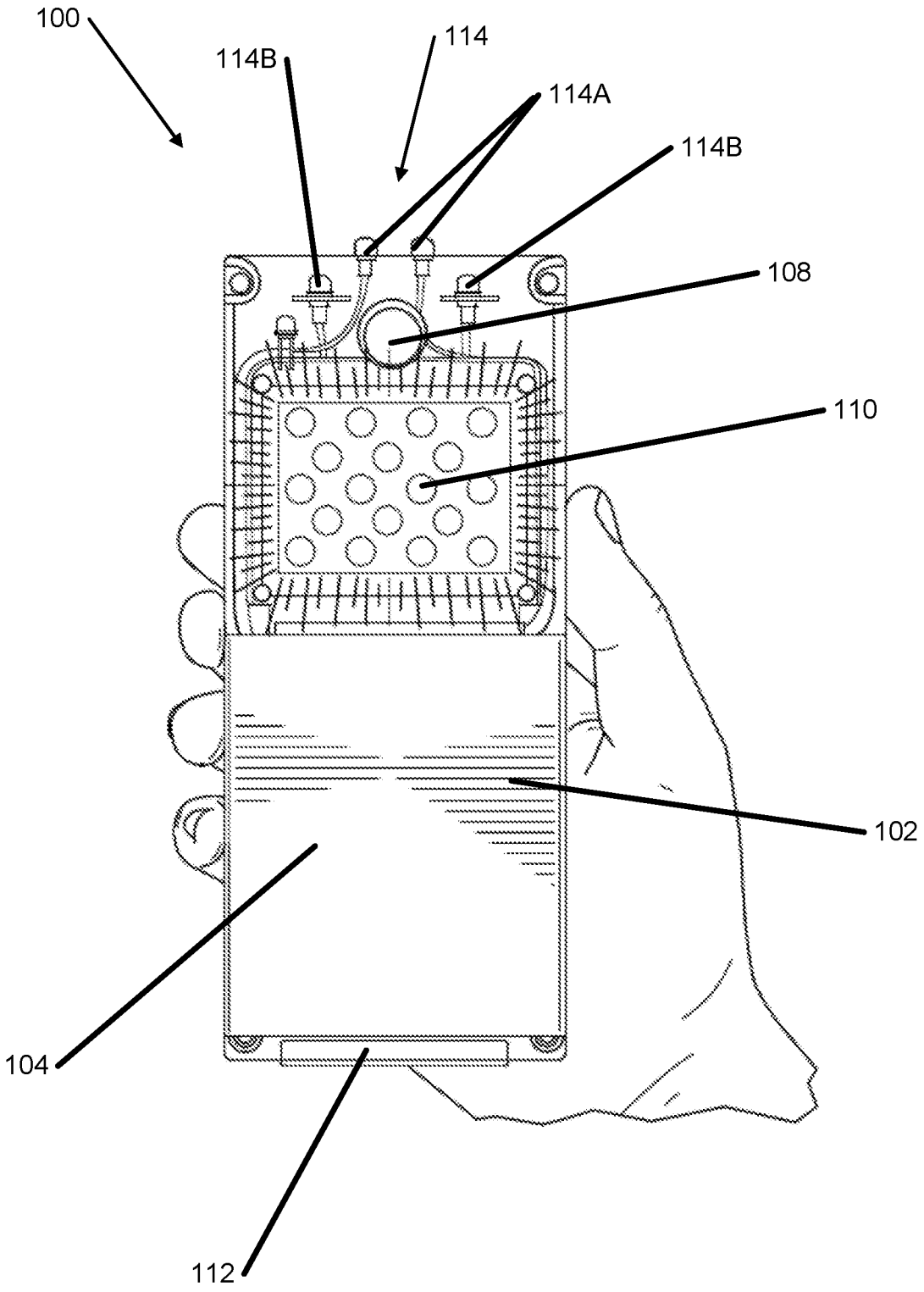
FIG. 3 is a front view of the lantern/lantern/multi-functional LED light from FIG. 1A in a hand in accordance with an embodiment of the system of the present invention.

In another embodiment of the invention, as illustrated in FIG. 2, the lantern/multi-functional LED light 100 can be used as a flash light 114. The flash light 114 of the lantern/multi-functional LED light 100 may be located on the top panel 107A of the case 102. The flash light 114 may include two bright top-mounted LED lights 114A. The flash light 114 may also include two top-side LEDs 114B. The flash light 114 may allow the lantern/multi-functional LED light 100 to be used as a standard flash light. Additionally, the lantern/multi-functional LED light 100 may be sized to be placed in the vest pocket 20 of a rail worker.

The lantern/multi-functional LED light 100 may include a selector button 108. The selector button 108 may allow the lights on the lantern/multi-function LED light 100 to be turned on and off. The selector button 108 may turn on the work light 110, the front array of lights 110A, the back array of lights 110B, and the flash light 114. The selector button 108 may turn off the work light 110, the front array of lights 110A, the back array of lights 110B, and the flash light 114. The selector button 108 may also cycle through all of the lights, such as the work light 110, the front array of lights 110A, the back array of lights 110B, and the flash light 114. In an embodiment, the selector button 108 may be programmed by various methods in order to provide and define the controls for the selector button 108.

In another embodiment of the invention, the lantern/multi-functional LED light 100 may have a sensor built in that turns one side off when the lantern/multi-functional LED light 100 is placed in a vest pocket 20. The sensor may provide orientation position indication and an automatic ON/OFF for one side when that side of the lantern/multi-functional LED light 100 is facing the vest pocket 20. For example, if the front panel 106A is facing outward and the back panel 106B is facing the vest pocket 20, the sensor will allow the front array of lights 110A to be on and turn the back array of lights 110B to be off. If the lantern/multi-functional LED light 100 is rotated within the vest pocket 20, so that the front panel 106A is facing the vest pocket 20 and the back panel 106B is facing outward, the sensor will turn on the back array of lights 110B and turn off the front array of lights 110A.

The lantern/multi-functional LED light 100 includes one or more of the following features: two-sided with rows of extra-bright warning LEDs that allow the lantern/multi-functional LED light 100 to light-up a work area, multi-color with different flash rates, sensor to allow for orientation position indication and automatic ON/OFF on one side, bottom base magnetic mount, two bright top-mounted LED lights and two side-top LEDs that allow the lantern/multi-functional LED light 100 to be used as a flash light.

It is to be understood that the invention is not limited in its application to the details of construction and the arrangement of the components set forth herein. The invention is capable of other embodiments and of being practiced or being carried out in various ways. Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

While the preferred embodiments of the invention have been shown and described, it will be apparent to those skilled in the art that changes and modifications may be made therein without departing from the spirit of the invention, the scope of which is defined by this description.

I claim:

1. A hand-held railway lantern for use on a railway, the hand-held railway lantern including:

a case including a front panel, a back panel opposite the front panel, a top panel, a bottom panel, and two side panels connected to form a rectangular shape;

a work light including a front array of lights on the front panel and a back array of lights on the back panel, each array of lights including a plurality of light-emitting diode (LED) lights located on the front panel and the back panel, the plurality of LED lights including a plurality of extra-bright LED lights with multi-colors, the work light configured to have two-sided light capability, the two-sided light capability configured to provide warning and lighting via both the front array of lights and the back array of lights;

a flash light located on the top panel, the flash light including two bright top-mounted LED lights; and a sensor configured to:

provide orientation position indication, and turn on the back array of lights and turn off the front array of lights based on the front panel being covered, or turn on the front array of lights and turn off the back array of lights based on the back panel being covered.

2. The hand-held railway lantern of claim 1, wherein the case includes:

a set of batteries and other electronics of the hand-held railway lantern;

a first housing defined by the front panel, the front array of lights disposed in the first housing; and a transparent cover disposed over the first housing.

3. The hand-held railway lantern of claim 1, wherein the front array of lights includes at least 16 extra-bright LED lights orientated in a plurality of rows and facing a first direction that is substantially perpendicular to the front panel.

4. The hand-held railway lantern of claim 1, wherein the plurality of LEDs on the work light have various flash rates and colors.

5. The hand-held railway lantern of claim 1, further including a clip coupled to the case and configured to hang the hand-held railway lantern that allows the work light to light-up a work area when a rail worker needs to work hands-free.

6. The hand-held railway lantern of claim 1, wherein the flash light further includes two side-top LED lights positioned on the front panel between the front array of lights and the flash light.

7. The hand-held railway lantern of claim 1, further including a magnetic base located on the bottom panel, the magnetic base configured to secure the hand-held railway lantern on a running rail for shunting applications or warning applications.

8. The hand-held railway lantern of claim 1, wherein the front panel includes:

a first portion that includes the front array of light; and a second portion that does not comprise lights, the second portion sized to fit within a pocket of a work vest such that the first portion extends outside of the pocket.

9. The hand-held railway lantern of claim 1, further including a selector button located on the case and configured to turn on and turn off the work light and the flash light.

10. The hand-held railway lantern of claim 8, wherein the front array of lights includes 16 extra-bright LED lights orientated in a plurality of rows with various flash rates and colors.

11. The hand-held railway lantern of claim 10, wherein the back array of lights includes 16 extra-bright LED lights orientated in a plurality of columns with various flash rates and colors.

12. The hand-held railway lantern of claim 9, wherein the selector button is configured to actuate the front array of lights, the back array of lights, and the flash light.

13. The hand-held railway lantern of claim 12, wherein the selector button is configured to cycle through actuation of the front array of lights, the back array of lights, and the flash light.

14. The hand-held railway lantern of claim 1, wherein:

the case is dimensioned to fit within a vest pocket of a worker vest;

the sensor is configured to:

determine, while the case is within the vest pocket, whether the front panel or back panel is facing the worker vest; and based on a determination that the front panel is facing the worker vest, prohibit activation of the front array of lights.

15. The hand-held railway lantern of claim 14, wherein the sensor is configured to, based on a determination that the back panel is facing the worker vest, prohibit activation of the back array of lights.

16. A method for operating a hands-free railway lantern, the method comprising:

actuating each of:

a first array of lights positioned on a first panel of a case, the first array of lights including a first plurality of LED lights having extra-bright LED lights with multi-colors;

a second array of lights positioned on a second panel of the case that is opposite the first panel, the second array of lights including a second plurality of LED lights having extra-bright LED lights with multi-colors; and a flash light positioned on a third panel of the case that extends between the first panel and the second panel, the flash light including a third plurality of LED lights;

determining, via a sensor, whether the first panel is covered; and based on a determination that the first panel is covered, prohibiting actuation of the first array of lights and actuating the second array of lights.

17. The method of claim 16, further comprising:

determining, via a sensor, whether the second panel is covered; and based on a determination that the second panel is covered, prohibiting actuation of the second array of lights.

18. The method of claim 17, further comprising, based on the first panel being covered, actuating the second array of lights.

19. The method of claim 18, further comprising, based on a determination that the second panel is covered, actuating the first array of lights.

20. The method of claim 17, further comprising actuating a selector button located on the case, the selector button configured to cycle though actuation of the first array of lights, the second array of lights, and the flash light.

* * * * *